US006257390B1

(12) United States Patent
Tehrani

(10) Patent No.: US 6,257,390 B1
(45) Date of Patent: Jul. 10, 2001

(54) SKIRT PANEL FOR A PASSENGER CONVEYOR

(76) Inventor: Cyrus M. Tehrani, 9 Drum Hill La., Stamford, CT (US) 06902

( * ) Notice: Subject to any disclaimer, the term of this patent is extended or adjusted under 35 U.S.C. 154(b) by 0 days.

(21) Appl. No.: 09/403,911

(22) PCT Filed: May 11, 1998

(86) PCT No.: PCT/US98/09642

§ 371 Date: Oct. 27, 1999

§ 102(e) Date: Oct. 27, 1999

(87) PCT Pub. No.: WO98/51594

PCT Pub. Date: Nov. 19, 1998

(51) Int. Cl.[7] ..... B66B 21/00
(52) U.S. Cl. ..... 198/326; 198/321
(58) Field of Search ..... 198/321, 323, 198/326, 333, 335

(56) References Cited

U.S. PATENT DOCUMENTS 3,144,118 * 8/1964 Fabula ..... 198/326 X
3,799,060 * 3/1974 Johnson ..... 198/335 X
5,810,147 * 9/1998 Vanmoor ..... 198/326 X

FOREIGN PATENT DOCUMENTS

2556321 * 6/1977 (DE) ..... 198/321

* cited by examiner

*Primary Examiner*—James R. Bidwell
(74) *Attorney, Agent, or Firm*—Ohlandt, Greeley, Ruggiero & Perle, LLC; George W. Rauchfuss

(57) ABSTRACT

A skirt panel for a passenger conveyor, particularly an escalator having a plurality of steps. The skirt panel has a plurality of ball bearings that protrude enough from its surface to give a sliding and/or deflecting action to traveling objects so as to reduce skirt panel surface friction and to minimize side of step entrapments. The skirt panel can be fitted for installation as a skirt panel or as an overlay to an already installed skirt panel.

36 Claims, 5 Drawing Sheets

SKIRT PANEL FOR A PASSENGER CONVEYOR

FIELD OF INVENTION

This invention relates to passenger conveyors and, in particular, to a skirt panel for passenger conveyors.

BACKGROUND OF INVENTION

Passenger conveyors such as escalators and moving walks typically have a frame that supports a passenger moving portion upon which passengers are situated and a drive for causing the moving portion to travel along the frame. The moving portion has a series of steps for the case of an escalator and a flat platform for the case of a moving walk. A pair of balustrades having handrails, skirt panels and balustrade panels is attached to the frame and is substantially vertically disposed on either side of the moving portion.

The skirt panel extends along and adjacent the moving portion, for example escalator steps, and extends vertically upward from the treads of the steps. The skirt panel is generally stationary while the escalator steps are in motion. The skirt panel and moving escalator steps are separated by a skirt/step gap that is usually 1/16 inch or more, but may be smaller.

Passenger injuries have occurred by entrapment in the skirt/step gap of objects such as body parts, clothing or accessories. Body parts that have been entrapped include limbs, fingers, feet, toes, hair and the like. Clothing that has been entrapped includes shoes, shoe laces, draw strings, scarves and the like. Accessories that have been entrapped include pocket books, book bags, back packs and the like.

Entrapment occurs as a result of the moving object coming in contact with the stationary skirt panel, being slowed or stopped by the frictional force of the contact and then being forced into the skirt/step gap as the escalator steps continue to move. Entrapment can occur at any point along the skirt/step gap. Any point where entrapment occurs, is known as the pinch point. For example, one point of the skirt/step gap where many entrapments occur is the juncture of the tread of one step and the riser of the next step. Some known skirt panels have deflected away from the moving steps upon heavy contact so that the skirt/step gap and pinch point becomes enlarged, thereby enhancing the chance of an entrapment The entrapment problem has been addressed in several ways. U.S. Pat. No. 5,695,040 discloses an escalator that has a brush or a wiper disposed in the skirt/step gap as a blocking member. Both the brush and the wiper are flexible so that objects that enter the skirt/step gap are still subject to seizure and entrapment.

A side-of-step entrapment product, available under the SafetyStrip™ trademark from Adams Elevator Company of Niles, Ill. is a continuous brush that is installed along the length of the skirt panel. The brush is supposed to warn passengers of impending danger when they or their clothing contact it and to present a barrier that must be penetrated to reach the skirt/step gap. This may work for some passengers, but not all. There are some passengers whose limbs (for example, their feet) will miss the brush and contact the skirt panel and be forced into the skirt/step gap. Other passengers will bump hard into the brush, penetrate the brush barrier and contact the skirt panel so as to be exposed to entrapment in the skirt/step gap. Some items of clothing may miss the brush and become entrapped. Other items of clothing that contact the brush may still contact the skirt panel and become entrapped.

Another technique has been to coat the skirt panel with a low friction material having a low coefficient of friction (lower than that of stainless steel). However, the materials used have not reduced friction enough to overcome the entrapment problem.

An escalator step guidance system, available under the SureGuide™ trademark from Schindler Elevator Corp. of Morristown, N.J. reduces the skirt/step gap size by means of a screw and wiper pad assembly that is mounted below each step tread. Whether the skirt/step gap is 1/16 inch, larger or smaller, there is a skirt/step gap in which objects may be entrapped.

SUMMARY OF INVENTION

An object of the present invention is to provide a new and improved skirt panel for a passenger conveyor.

Another object of the present invention is to provide a skirt panel having a surface that causes a moving object to move or slide along the surface and, thus, reduce the effective friction of the surface.

Still another object of the present invention is to provide a skirt panel that deflects, bumps or pushes a moving object away from the panel surface.

Yet another object of the present invention is to provide a skirt panel that presents a low friction moveable surface to moving objects.

The foregoing and other objects are provided in the present invention by a skirt panel having a structure that has a surface facing the moving portion of a passenger conveyor. For the case of an escalator, the moving portion is the escalator steps. One or more moveable elements is mounted in the surface of the skirt panel so as to provide a low friction moveable surface to moving objects.

In a preferred embodiments the moveable elements are bearings mounted in the structure so that a portion of each bearing protrudes outwardly from the skirt panel surface so as to provide a sliding action for objects that contact the bearings as the steps travel.

The bearings are mounted in holders within the structure. The holders hold the bearings in place and allow the bearings to provide the sliding action. In some preferred embodiments of the present invention, the bearings are ball bearings.

The bearings are scattered about the skirt panel surface in an array and are spaced close enough to provide the sliding action and a reduction in surface friction. In some preferred embodiments of the present invention, the array is a honeycomb pattern.

In one preferred embodiment of the present invention, the structure includes a first layer whose front surface is the skirt panel surface. This layer has a plurality of apertures through which the bearings protrude. The structure also has a second layer that contains the bearing holders. The second layer is disposed behind the first layer with the bearing holders in registry with the apertures of the first layer.

In a preferred embodiment of the present invention, each bearing holder is a cavity that extends through the second layer. A third layer of the structure is disposed behind the second layer for retaining the bearings within the cavities.

BRIEF DESCRIPTION OF DRAWINGS

Other and further objects, advantages and features of the present invention will be understood by reference to the following specification in conjunction with the accompanying drawings, in which like reference characters denote like elements of structure and.

DESCRIPTION OF PREFERRED EMBODIMENTS

The skirt panel of the present invention is useful in passenger conveyors of all types. However, by way of example and completeness of description, the skirt panel of the present invention will be described herein for escalator type passenger conveyors.

Figure 1:
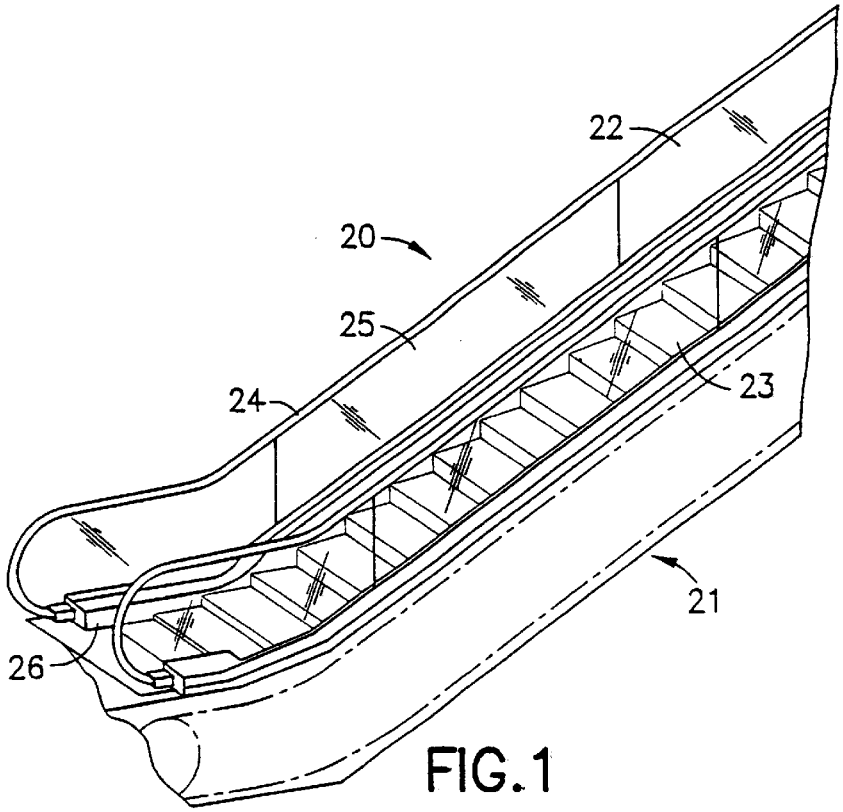
FIG. 1 is a perspective view of a portion of an escalator.
Figure 2:
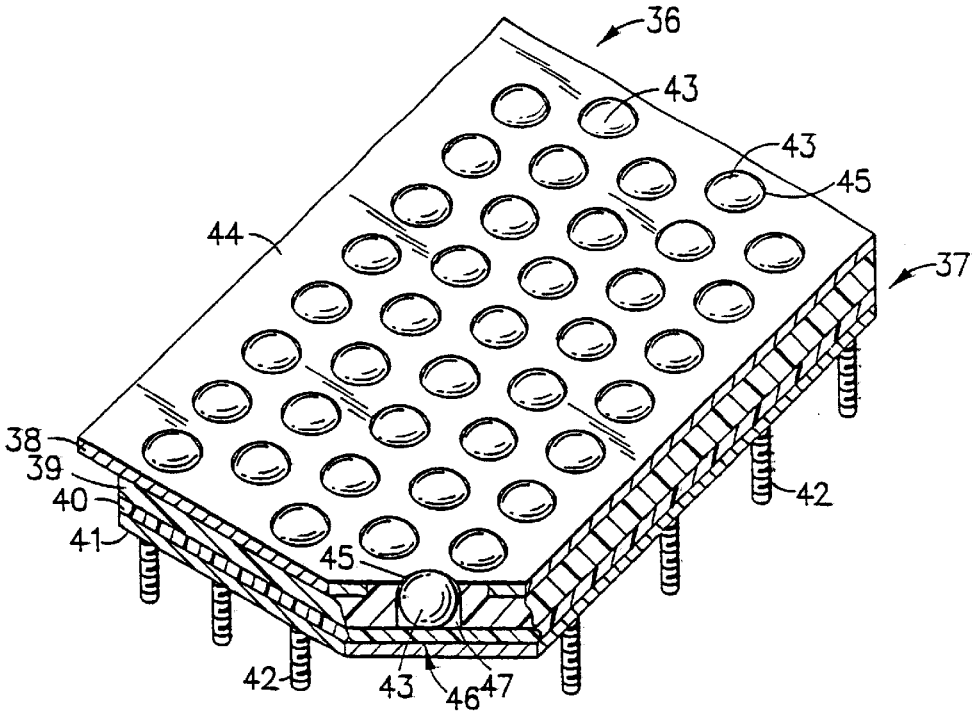
FIG. 2 is a perspective view of a skirt panel in accordance with one preferred embodiment of the present invention.
Figure 3:
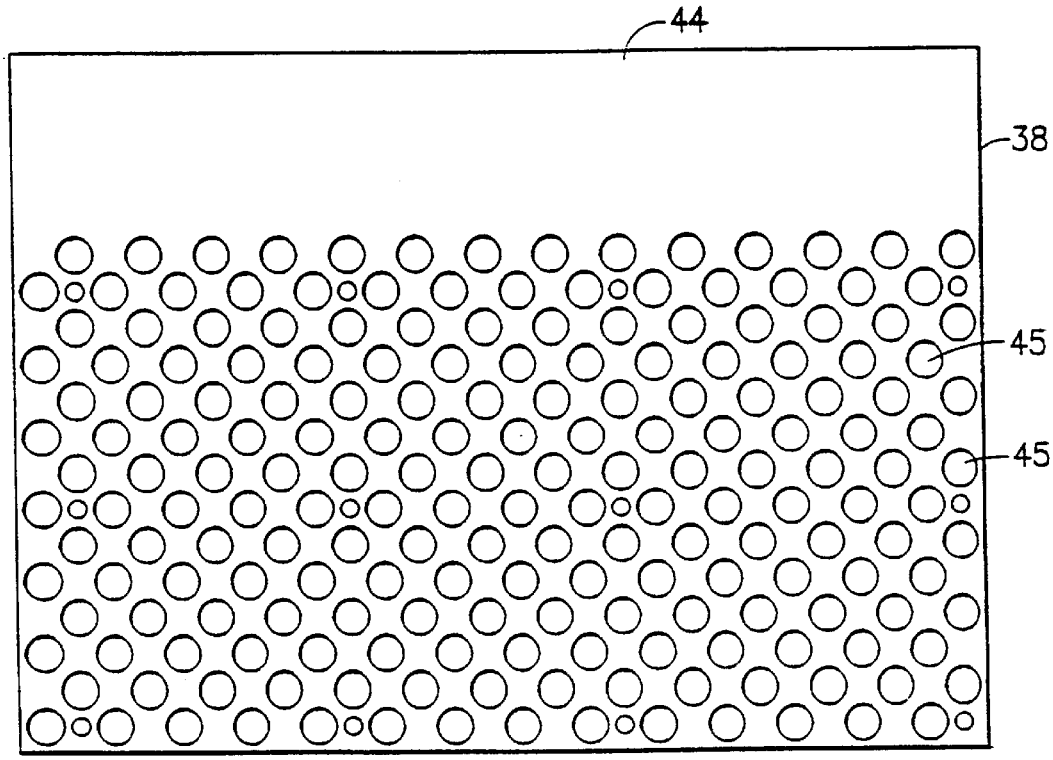
FIG. 3 is a top view of a first layer of the skirt panel of FIG. 2.
Figure 4:
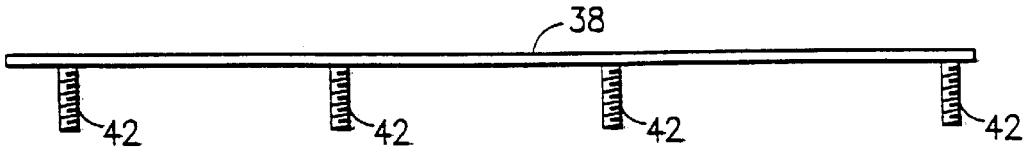
FIG. 4 is an elevational view of the first layer of FIG. 3.
Figure 5:
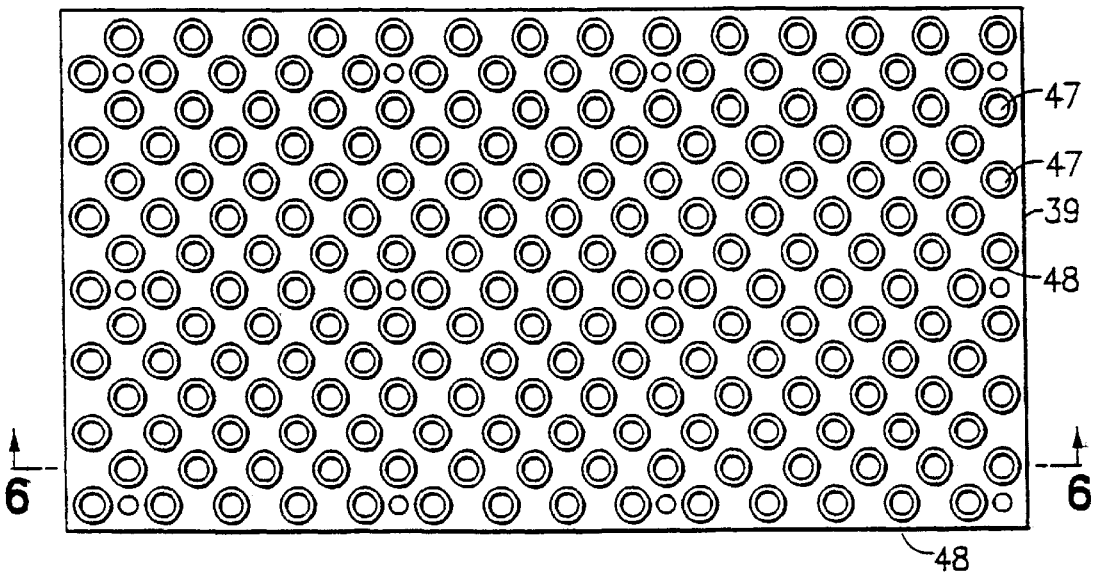
FIG. 5 is a top view of a second layer of the skirt panel of FIG. 2.
Figure 6:
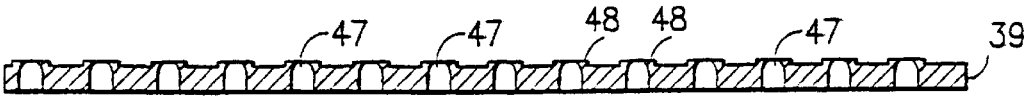
FIG. 6 is a cross section view along the lines 6—6 of FIG. 5.
Figure 7:
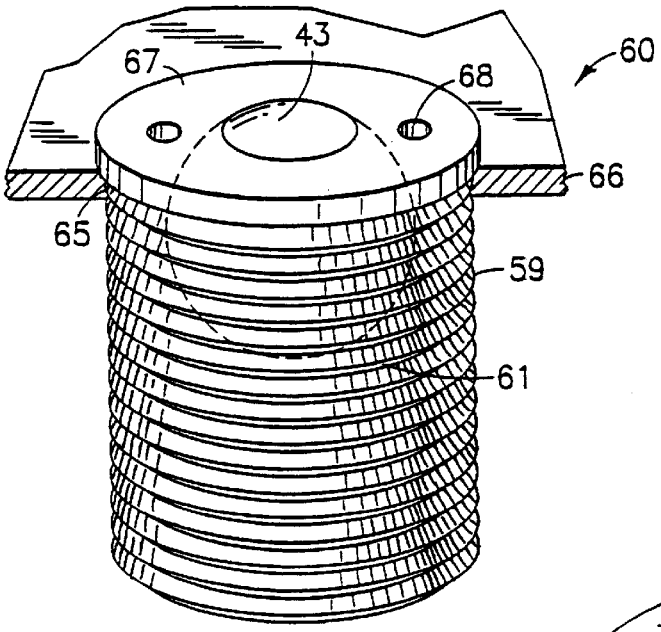
FIG. 7 is a perspective view of another skirt panel embodiment of the present invention.
Figure 8:
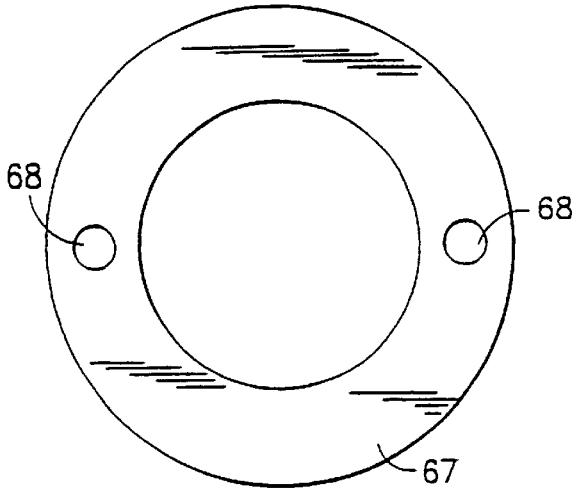
FIG. 8 is a top view of the bearing and plug assembly of FIG. 7.
Figure 9:
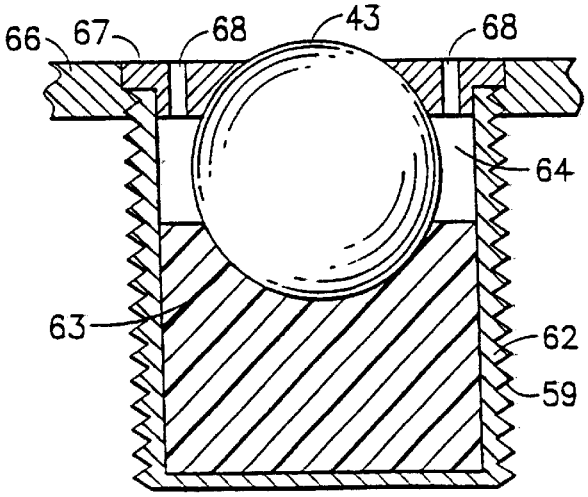
FIG. 9 is a cross sectional view of FIG. 7.

Referring to FIG. 1, an escalator 20 is generally represented by numeral 20. Escalator 20 has a frame 21, a drive (not shown), a pair of balustrades 22 and a plurality of steps 23. Each balustrade 22 has a handrail 24, a balustrade panel 25 and a skirt panel 26. At the interface of skirt panel 26 and steps 23 is a skirt/step gap that for many current designs is typically about 1/16 inch, but may be smaller or larger.

Steps 23 are driven by the drive in a generally circuitous path in either the up or down direction. Balustrade panels 22 and skirt panels 26 remain stationary as the steps move. Passenger injuries have occurred by entrapment in the aforementioned skirt/step gap of objects such as body parts, clothing or accessories. The entrapment occurs as a result of the moving object coming in contact with stationary skirt panel 26, being slowed or stopped by the frictional force of the contact and then being forced into the skirt/step gap as escalator steps 23 continue to move.

With reference to FIGS. 2 through 6, there is provided a skirt panel generally represented by numeral 36 according to a preferred embodiment of the present invention. Skirt panel 36 has a structure generally represented by numeral 37. Structure 37 has first, second, third and fourth layers 38, 39, 40 and 41, respectively. First, second, third and fourth layers 38, 39, 40 and 41 are held together in a sandwich fashion by means of any suitable fastening technique as, for example, by bolts 42 that extend downwardly from first layer 38 through layers 39, 40 and 41. The sandwich structure 37 is secured by nuts (not shown) applied to the screw thread portions of bolts 42.

Structure 37 contains a plurality of moveable elements 43 that provide a low friction moving surface for moving objects that contact any of the moveable elements. Although the moveable elements may be any moveable parts such as belts, rotatable cylinders, disks, plates, panels, balls and the like, the moveable elements are preferably bearings that protrude above or are flush with the top surface 44 of first layer 38. The bearing protrusions are small enough to fit within the skirt/step gap or can contact the steps. Bearings 43 have one or more directions of rotation and in preferred embodiments are ball bearings that have an infinite number of directions of rotation.

Bearings 43 are scattered about top surface 44 in an array that in preferred embodiments is a honeycomb pattern. The spacing of bearings 43 in the array is close enough to impart a sliding and/or deflecting action to moving objects that contact top surface 44 as escalator steps 23 travel by skirt panel 36 so as to provide an effective reduction of surface friction. When such contact is made with bearings 43, body parts, clothing accessories or other objects can be pulled away with ease and without panic by sliding or deflecting them away and, thus, eliminating frictional force effect, thereby reducing the risk of entrapment. This action also causes a sensation, making a passenger aware of contact with skirt panel 36 that serves as a warning to pull away the object that has made contact. The protruding ball bearings 43 have the effect of reducing the size of the skirt/step gap by the amount of the protrusions of the ball bearings.

First layer 38 contains a plurality of apertures 45 through which bearings 43 protrude. Structure 37 contains a plurality of bearing holders 46 arranged in registry with apertures 45 of first layer 38. Bearing holders 46 are formed by cavities 47 that extend through second layer 39. Bearings 43 reside in respective cavities 47 bounded at the bottom by third layer 40. Third layer 40 has a low coefficient friction so as to provide a smooth low friction surface for bearings 43. Each cavity 47 has a rim portion 48 that is shaped to closely match the bearing contour and dimensioned so as to minimize entry of contaminants into cavities 47 that can cause interference with bearing providing the moving or sliding action. Each rim portion 48 is an annulus that extends upwardly into a corresponding aperture 45 of first layer 38.

Skirt panel 36 is preferably made in modular sections that can be fit together to form an entire skirt panel 26 when installed on an escalator. Alternatively, sections of skirt panels 36 can also be disposed in specific problem areas where contact with moving objects is expected. Skirt panel 36 can be dimensioned to fit over the front or back of an existing skirt panel 26 by means of bolts or other fastening techniques such that the bearing surface is the skirt panel surface.

The materials for first, second, third and fourth layers 38, 39, 40 and 41 are selected to give strength to skirt panel 36 so that it does not deflect away from the steps and widen the skirt/step gap upon contact with an object and to give low coefficient of friction surfaces for bearings 43. In one embodiment, first and fourth layers 38 and 41 are stainless steel, second layer 39 is an acetyl plastic available under the DELRIN® trademark from A. L. Hyde Company of Grenloch, N.J. and third layer is a plastic available under model UHMW from A. L. Hyde Company.

Bearings 43 can be made of any low friction coefficient and durable material such as steel, ceramic or plastic. In the aforementioned embodiment, bearings 43 are stainless steel ball bearings.

In some embodiments, the bearings, when spinning and contacting the plastic second and third layers, can emit an audible noise which alerts the passenger to avoid entrapment.

Provision can be made for lubricating bearings 43 as, for example, by use of a lubricant impregnated plastic for layers 39 and/or 40 or by use of a lubricating port and channel system (not shown in FIGS. 1 through 6) in structure 37.

FIGS. 7 through 12 show another group of embodiments of the present invention that employ bearing assemblies in the form of plugs that can be plugged into holes closely spaced about a skirt panel either entirely or just in expected problem areas. The plugs can be installed one by one in an installed skirt panel or can be installed in a separate skirt panel section or module that can be placed over the front or back of or replace an installed skirt panel. The protrusions of the ball bearings is low enough to fit in the skirt/step gap. This enables the step sides to pass and even contact the bearings, leaving little or no clearance in the skirt/step gap.

In FIGS. 7 through 10, a bearing assembly is generally designated by numeral 60. Bearing assembly 60 has a plug 61 that is plugged into an aperture 65 in a skirt panel 66. Plug 61 has a body 62 of durable material such as stainless steel or plastic. In the illustrated embodiments, body 62 is stainless steel and has a cylindrical shape with screw threads 59. Body 62 contains a plastic bearing holder 63 for bearing 43. The region 64 is open and contains air.

A rim 67 fits within the cylindrical top of body 62. Rim 67 is designed to the contour of bearing 43 to minimize entry of contaminants into body 62. Rim 67 has holes 68 that serve as grab holes for plug tightening into the skirt panel as well as lube ports for lubricating bearing 43.

Figure 10:
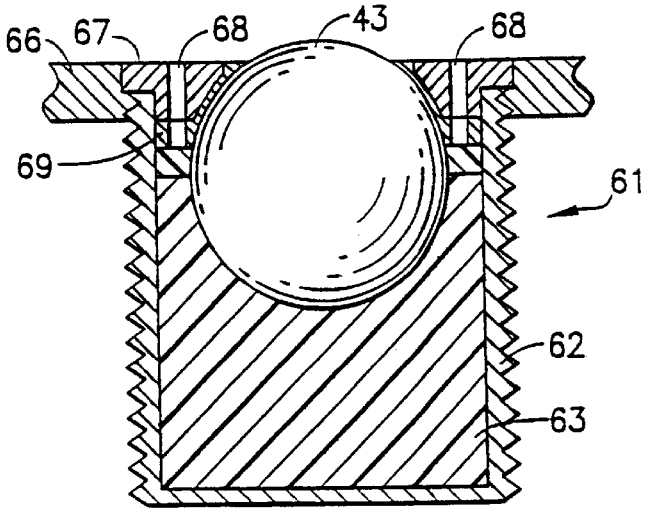
FIG. 10 is a cross sectional view of another skirt panel embodiment of the present invention.

In FIG. 10, plug 61 also has a guard ring 69 that serves as a barrier to entry into bearing holder 63 of debris such as dirt, lint and the like. Bearing holder 63 is constructed of two pieces so as to occupy substantially all of the space within plug body 62.

Figure 11:
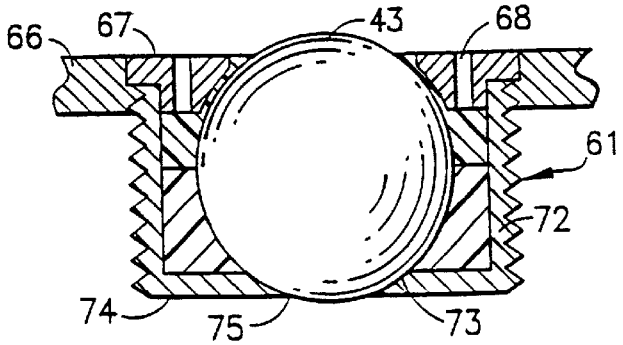
FIG. 11 is a cross sectional view of yet another skirt panel embodiment of the present invention.
Figure 12:
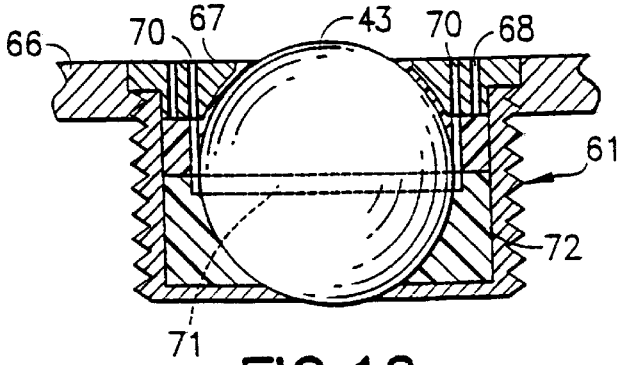
FIG. 12 is a cross sectional view of a further skirt panel embodiment of the present invention.

FIGS. 11 and 12 show another plug type embodiment that has a cylindrical body 72 that has disposed in its bottom 74 an aperture 75. Body 72 contains a bearing holder 73 for bearing 43. A portion of bearing 43 extends through aperture 75. Aperture 75 serves as an exit for debris and allows bearing 43 to roll freely.

In FIG. 12, rim 67 has separate lube ports 70 connecting to lube channels 71 that provide lubrication to bearing 43 in body 72 In one design, the channels 71 surround bearing 43.

Although not illustrated, another plug embodiment of the present invention includes a bearing holder structure of the type shown in FIGS. 2 through 6 where the bearing holder is bounded on the bottom by a body with a smooth plastic surface, such as the aforementioned model UHMW.

The present invention having been thus described with particular reference to the preferred forms thereof, it will be obvious that various changes and modifications may be made therein without departing from the spirit and scope of the present invention as defined in the appended claims.

What is claimed is:

1. An escalator skirt panel having a surface that faces the traveling steps of an escalator, said escalator skirt panel comprising:

a structure that includes said surface;

a plurality of bearings; and means for mounting said bearings in said structure so that a portion of each said bearing protrudes outwardly from said surface so as to provide a sliding action for objects that contact said bearings as said steps travel.

2. The invention according to claim 1 wherein said means for mounting comprises:

a plurality of bearing holders that hold said bearings in place and allow said bearings to provide said sliding action.

3. The invention according to claim 2 wherein said structure further comprises:

a first layer having said surface as a front surface and a back surface, said front surface having a like plurality of apertures through which said bearings protrude.

4. The invention according to claim 3 wherein said structure further comprises:

a second layer having a front surface containing said bearing holders and situated with respect to said back surface of said first layer so that said bearing holders are in registry with said apertures.

5. The invention according to claim 4 wherein said structure further comprises:

said second layer having a back surface;

each said bearing holder comprises a cavity that extends through said second layer between said front and back surfaces thereof; and a third layer for retaining and providing a smooth low coefficient of friction surface for said bearings within said cavities.

6. The invention according to claim 5 where said bearings are ball bearings.

7. The invention according to claim 6 wherein said plurality of bearings are situated in an array scattered about said surface.

8. The invention according to claim 7 wherein said array is a honeycomb pattern.

9. The invention according to claim 8 wherein each said bearing holder comprises:

a rim portion extending over a portion of said bearing contained therein to minimize entry of contaminants into the bearing holder.

10. The invention according to claim 9 and further comprising:

means for holding said layers together.

11. The invention according to claim 10 wherein the first, second and third layers have low enough coefficients of friction to allow said bearings to move.

12. The invention according to claim 11 wherein said first layer is metal, and said second and third layers are plastic.

13. The invention according to claim 1 wherein said plurality of bearings is situated in an array scattered about said surface.

14. The invention according to claim 13 wherein said array is a honeycomb pattern.

15. The invention according to claim 14 wherein said bearings are ball bearings.

16. The invention according to claim 2 wherein each said bearing holder comprises:

a rim portion extending over a portion of said bearing contained therein to minimize entry of contaminants into said bearing holder that would interfere with said bearing providing said sliding action.

17. The invention according to claim 2 and further comprising: means for facilitating removal of contaminants from said bearing holders.

18. The invention according to claim 2 wherein at least one of said bearing holders comprises:

a plug having a cavity for holding one of said bearings.

19. The invention according to claim 18 wherein said plug contains at least one lubricating port.

20. The invention according to claim 19 wherein said cavity is an open cavity.

21. A skirt panel having a surface that faces the traveling portion of a passenger conveyor, said skirt panel comprising:

a structure that includes said surface;

a plurality of bearings; and means for mounting said bearings in said structure so that a portion of each said bearing protrudes outwardly from said surface so as to provide a sliding action for objects that contact said bearings.

22. The invention according to claim 21 wherein said means for mounting comprises:

a plurality of bearing holders that hold said bearings in place and allow said bearings to provide said sliding action.

23. The invention according to claim 22 wherein said structure further comprises:

a first layer having said surface as a front surface and a back surface, said front surface having a like plurality of apertures through which said bearings protrude.

24. The invention according to claim 23 wherein said structure further comprises:

a second layer having a front surface containing said bearing holders and situated with respect to said back surface of said first layer so that said bearing holders are in registry with said apertures.

25. The invention according to claim 24 wherein said structure further comprises:

said second layer having a back surface;

each said bearing holder comprises a cavity that extends through said second layer between said front and back surfaces thereof; and a third layer for retaining and providing a smooth low coefficient of friction surface for said bearings within said cavities.

26. The invention according to claim 25 where said bearings are ball bearings.

27. The invention according to claim 26 wherein said plurality of bearings are situated in an array scattered about said surface.

28. The invention according to claim 27 wherein said array is a honeycomb pattern.

29. The invention according to claim 28 wherein each said bearing holder comprises:

a rim portion extending over a portion of said bearing contained therein to minimize entry of contaminants into the bearing holder that would interfere with said bearing providing said sliding action.

30. The invention according to claim 29 and further comprising:

means for holding said layers together.

31. The invention according to claim 30 wherein the first, second and third layers have low enough coefficients of friction to allow said bearings to move.

32. The invention according to claim 31 wherein said first layer is metal, and said second and third layers are plastic.

33. A skirt panel having a surface that faces the traveling portion of a passenger conveyor, said skirt panel comprising:

a structure that includes said surface;

at least one moveable element; and means for mounting said moveable element in said structure so as to provide a low friction moveable surface for objects that contact said moveable element.

34. A skirt panel in accordance with claim 33 wherein said moveable element is one of a plurality of moveable elements; and said objects travel with said traveling portion.

35. A skirt panel in accordance with claim 34 wherein said means for mounting includes a plurality of holders to hold said moveable elements in place and allow said moveable elements to provide said low friction moveable surface to said objects that contact any of said moveable elements.

36. A skirt panel in accordance with claim 35 wherein said structure further comprises:

a first layer having said surface as a front surface and a back surface, said front surface having a like plurality of apertures through which said moveable elements protrude.

* * * * *